United States Patent [19]

Toda et al.

[11] 4,327,175

[45] Apr. 27, 1982

[54] SILVER HALIDE COLOR PHOTOGRAPHIC LIGHT-SENSITIVE MATERIAL

[75] Inventors: Yuzo Toda; Hidetoshi Kobayashi; Junji Koizumi, all of Minami-ashigara, Japan

[73] Assignee: Fuji Photo Film Co., Ltd., Minami-ashigara, Japan

[21] Appl. No.: 258,215

[22] Filed: Apr. 27, 1981

[30] Foreign Application Priority Data

Apr. 25, 1980 [JP] Japan ..... 55/55084

[51] Int. Cl.[3] ..... G03C 1/40

[52] U.S. Cl. ..... 430/546; 430/551; 430/557; 430/558

[58] Field of Search ..... 430/546, 551, 557, 558

[56] References Cited

U.S. PATENT DOCUMENTS

| | | | |
|---|---|---|---|
| 4,217,410 | 8/1980 | Nakamura et al. | 430/546 |
| 4,250,251 | 2/1981 | Osborn et al. | 430/505 |
| 4,266,019 | 5/1981 | Kobayashi et al. | 430/558 |
| 4,278,757 | 7/1981 | Mukunoki et al. | 430/546 |

*Primary Examiner*—L. Travis Brown

*Attorney, Agent, or Firm*—Sughrue, Mion, Zinn, Macpeak & Seas

[57] ABSTRACT

A silver halide photographic light-sensitive material having on a support at least one layer containing a color coupler selected from the compounds represented by the general formulae (III) and (IV). The coupler is dispersed using a high boiling point organic solvent selected from the compounds represented by the general formulae (I) and (II). By the combined use of such a color coupler and high boiling point organic solvent, it is possible to prevent color deepening which occurs with the lapse of time, and prevent the formation of dye stain in an area not to be developed during the development process.

(I)

wherein $R_1$ is an alkyl group, an alkoxy group, an acyloxy group, an aryloxy group or a halogen atom; $R_2$ is a cyclic saturated hydrocarbon residue; m is 0 or an integer of 1 to 5; and n is an integer of 1 to 6; and wherein when m or n is an integer of 2 or more, each $R_1$ and $R_2$ may be the same or different.

(II)

wherein $R_3$ is a cyclic saturated hydrocarbon residue; and $R_4$ and $R_5$, which may be the same or different, each is a cyclic saturated hydrocarbon residue, an alkyl group or an aryl group.

(III)

wherein $R_6$ is an alkyl group containing 1 to 10 carbon atoms, which may be substituted with a phenyl group; $R_7$ is an alkyl group containing 1 to 12 carbon atoms, which may be substituted with an alkoxy group, an alkylsulfonamido group or an alkylsulfonyl group; $R_8$ is a chlorine atom or a methoxy group; $R_9$ is an alkyl group containing 10 to 20 total carbon atoms, which may be substituted with an alkoxy group, a phenoxy group, an alkoxycarbonyl group or an alkylsulfonamido group; and $R_{10}$ is hydrogen, a methyl group or a methoxy group.

(IV)

wherein $R_{11}$ is a chlorine atom or a methoxy group; $R_{12}$ is an alkyl group containing 10 to 20 total carbon atoms, which may be substituted with an alkoxy group, a phenoxy group, an alkylcarbonyl group or an alkylsulfonamido group; and X is a 2,4-dioxo-5,5-dimethyl-3-oxazolydinyl group or a group having the formula (wherein $R_{13}$ is an alkyl group containing 1 to 10 carbon atoms, which may be substituted with a phenyl group; and $R_{14}$ is an alkyl group containing 1 to 10 carbon atoms, which may be substituted with an alkoxy group, an alkylsulfonamido group or an alkylsulfonyl group).

16 Claims, No Drawings

SILVER HALIDE COLOR PHOTOGRAPHIC LIGHT-SENSITIVE MATERIAL

FIELD OF THE INVENTION

This invention relates to a silver halide color photographic light-sensitive material (hereinafter "color sensitive material") and, particularly, to a color sensitive material in which the formation of color stain (in an area not to be developed during the color development process) is prevented.

BACKGROUND OF THE INVENTION

A color sensitive material has the so-called color couplers in at least one of its photographic layers. The color couplers are allowed to react with an oxidized aromatic primary amino color developing agent by the color development of the color sensitive material to produce dyes, such as indophenols, indoanilines, indamines, azomethines, phenoxazines, phenazines and the like, and to form colored images.

In a color photographic process, the subtractive color method is usually employed for color reproduction. Silver halide emulsions which are sensitized selectively to blue, green and red lights are employed in combination with couplers which can form images with their respective complementary colors, namely, yellow, magenta and cyan, respectively. To form a yellow image, acylacetoanilide series couplers, and dibenzoylmethane series couplers may be used. To form a magenta image, pyrazolone, pyrazolobenzimidazole, cyanoacetophenone or indazolone series couplers are mainly used. Phenol series couplers such as phenols and naphthols are mainly used to form a cyan image.

These couplers are usually dissolved in high boiling point organic solvents selected from phthalic acid ester series compounds or phosphoric acid ester series compounds. After the couplers are dissolved, they are incorporated into photographic layers such as light-sensitive silver halide emulsion layers and so on.

Specific examples of the high boiling point organic solvents employed for this purpose are described in U.S. Pat. Nos. 2,322,027, 2,533,514, 3,287,134, 3,748,141 and 3,779,765, German Pat. No. 1,152,610, British Pat. No. 1,272,561, German Patent Application (OLS) No. 2,629,842, and so on.

Usually the development process for such color sensitive materials comprises a color developing step, a bleaching step, a fixing step and a washing step. The development process may utilize the so-called blix processing, wherein bleaching and fixing are combined and achieved simultaneously in the same bath. This blix step has been prevailingly carried out in recent years.

Dye images are formed by subjecting an imagewise exposed color sensitive material to such development processes. During such processes, color couplers develop their colors in areas to the extent that they cannot receive color development-processing and cannot produce dyes, resulting in the formation of color stain. The color stain formed in these areas during the development processing steps will be referred to hereinafter by the term "processing stain". A processing stain is especially likely to be formed during the color development process, especially in the bleaching step. A processing stain in a color sensitive material spoils the quality of the dye image formed. Therefore, the emergence of color sensitive materials in which no processing stain is formed has been desired.

The images produced by dyes have imagewise distributions as a result of such processings and the image may vary in different ways with the lapse of time. For instance, a yellow image formed by color development increases its density with the lapse of time. When this occurs the color balance between yellow and other colors (i.e., magenta and cyan) is broken and the quality of color image formed from these dye images is greatly deteriorated. This phenomenon is hereinafter described by the term "color deepening with the lapse of time". Because of this phenomenon there is a need to produce color sensitive materials free of color deepening with the lapse of time.

SUMMARY OF THE INVENTION

An object of the present invention is to provide a color sensitive material wherein no processing stain is formed.

A further object of the present invention is to provide a color sensitive material wherein color deepening with the lapse of time is prevented from occurring.

These objects and other objects which will become readily apparent to those skilled in the art upon reading this description are attained with a silver halide color photographic light-sensitive material which comprises a support having thereon at least one layer in which a color coupler dispersed within a high boiling point organic solvent. The high boiling point organic solvent is selected from the compounds represented by the following general formulae (I) and (II). The color coupler is selected from the compounds represented by the following general formulae (III) and (IV):

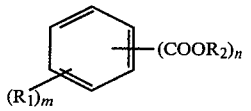

(I)

wherein $R_1$ is an alkyl group, an alkoxy group, an acyloxy group, an aryloxy group or a halogen atom; $R_2$ is a cyclic saturated hydrocarbon residue; m is 0 or an integer of 1 to 5; and n is an integer of 1 to 6; and wherein when m or n is an integer of 2 or more, each $R_1$ and $R_2$ may be the same as or different.

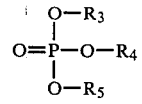

(II)

wherein $R_3$ is a cyclic saturated hydrocarbon residue; and $R_4$ and $R_5$, which may be the same or different, each is a cyclic saturated hydrocarbon residue, an alkyl group or an aryl group.

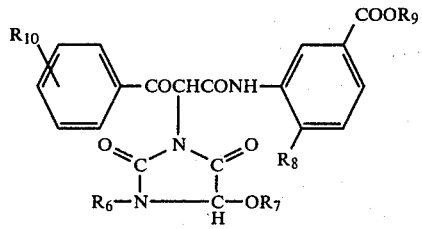

(III)

wherein $R_6$ is an alkyl group containing 1 to 10 carbon atoms, which may be substituted with a phenyl group; $R_7$ is an alkyl group containing 1 to 12 carbon atoms, which may be substituted with an alkoxy group, an alkylsulfonamido group or an alkylsulfonyl group; $R_8$ is a chlorine atom or a methoxy group; $R_9$ is an alkyl group containing 10 to 20 total carbon atoms (i.e., including carbon atoms of the substituent(s)), which may be substituted with an alkoxy group, a phenoxy group, an alkoxycarbonyl group or an alkylsulfonamido group; and $R_{10}$ is hydrogen, a methyl group or a methoxy group.

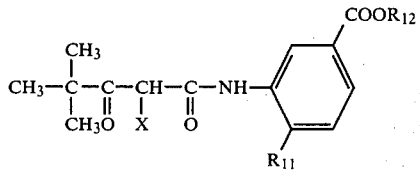

(IV)

wherein $R_{11}$ is chlorine or a methoxy group; $R_{12}$ is an alkyl group containing 10 to 20 total carbon atoms (i.e., including carbon atoms of the substituent(s)), which may be substituted with an alkoxy group, a phenoxy group, an alkylcarbonyl group or an alkylsulfonamido group; and X is a 2,4-dioxo-5,5-dimethyl-3-oxazolydinyl group or a group having the formula

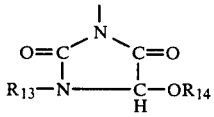

(wherein $R_{13}$ is an alkyl group containing 1 to 10 carbon atoms, which may be substituted with a phenyl group; and $R_{14}$ is an alkyl group containing 1 to 10 carbon atoms, which may be substituted with an alkoxy group, an alkylsulfonamido group or an alkylsulfonyl group).

DETAILED DESCRIPTION OF THE INVENTION $R_1$ in the formula (I) is preferably an alkyl group containing 1 to 12 carbon atoms, an alkoxy group containing 1 to 10 carbon atoms, an acyloxy group containing 1 to 20 carbon atoms, an aryloxy group containing 6 to 18 carbon atoms or a halogen atom such as a chlorine atom.

In addition, $R_1$ may be further substituted with other substituent groups such as fluorine atom etc.

Especially preferred $R_1$ is an alkoxy group containing 1 to 9 carbon atoms or a chlorine atom.

As the cyclic saturated hydrocarbon residues represented by $R_2$, those which contain 3 to 24 carbon atoms therein are preferred. These residues may be further substituted with other substituent groups. Examples of favored substituents in this case include alkyl groups, alkoxy groups, halogen atoms and so on. A particularly preferred residues as $R_2$ is a cyclohexyl group. The cyclohexyl group may have a certain substituent group. Examples of the preferred substituent group in this case include alkyl groups which contain 1 to 9 carbon atoms therein, a chlorine atom and so on.

Specific examples of the compounds represented by the general formula (I) are illustrated below.

Compound Examples:

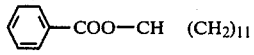

(I-1)

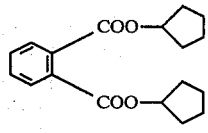

(I-2)

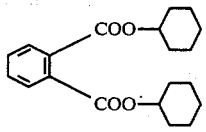

(I-3)

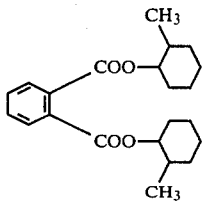

(I-4)

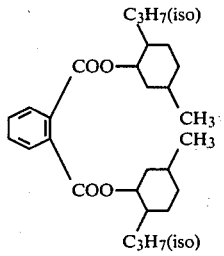

(I-5)

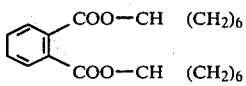

(I-6)

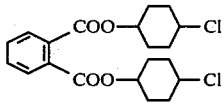

(I-7)

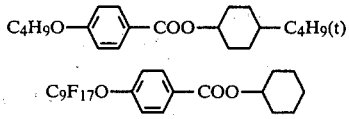

(I-8)

(I-9)

Aromatic esters to be employed in the present invention, which are represented by the general formula (I), can be generally obtained by allowing aromatic carboxylic acids or the anhydrides thereof and cyclic saturated alcohols to undergo dehydration reaction in the presence of a catalyst (such as sulfuric acid, p-toluenesulfonic acid or so on). Therein, benzene, toluene, xylene or the like may be optionally employed as a solvent with the intention of separating dehydrated water as the azeotrope thereof.

For details of the methods for synthesizing the compounds of the general formula (I), U.S. Pat. No. 4,193,802 can be referred to.

In the general formula (II), $R_3$ represents preferably substituted or unsubstituted cyclic saturated hydrocarbon residues containing 5 or more of carbon atoms. Examples of the substituent groups which substituted cyclic saturated hydrocarbon residues have include alkyl groups, aryl groups, alkoxy groups, cycloalkyl groups, alkoxyalkyl groups, acyloxy groups, halogen atoms and so on. $R_4$ and $R_5$ are each preferably a substituted or an unsubstituted cyclic saturated hydrocarbon residue containing 5 or more of carbon atoms (to whose substituent groups the same groups as those in the case of $R_3$ can be applied), a substituted or an unsubstituted alkyl group containing 1 to 30 carbon atoms (examples of which substituent group include an alkoxy group, a halogen atom, an aryl group, an acyloxy group, an aryloxy group and so on), or a substituted or an unsubstituted aryl group containing 6 to 24 carbon atoms (examples of which substituent group include an alkyl group, an alkoxy group, a halogen atom and so on). Particularly favored groups of the cyclic saturated hydrocarbon residues represented by $R_3$, $R_4$ or $R_5$ are substituted and unsubstituted cyclohexyl groups.

Specific examples of phosphoric acid esters of the general formula (II) which are preferably employed in the present invention are illustrated below.

Compound Examples:

(II-1)

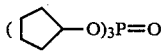

(II-2)

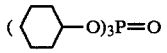

(II-3)

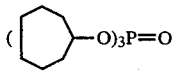

(II-4)

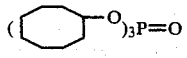

(II-5)

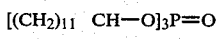

(II-6)

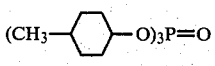

(II-7)

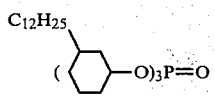

(II-8)

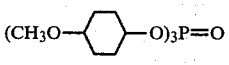

(II-9)

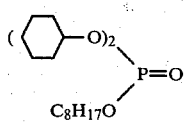

-continued

Compound Examples:

(II-10)

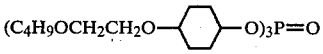

The phosphoric acid esters to be employed in the present invention, which are represented by the general formula (II), are generally obtained by reacting phosphorus oxychloride with cyclic saturated alcohols in the presence of a catalyst (e.g., bases such as pyridine, triethylamine and the like, titanium tetrachloride, etc.).

General methods for synthesizing such phosphoric acid esters are described in, for example, U.S. Pat. No. 3,209,021, Japanese Patent Publication No. 28429/73, U.S. Pat. Nos. 3,799,349 and 2,426,691, *Organophosphorus Compounds,* pages 266 and 288, John Wiley & Sons, Inc., New York (1950), and so on.

The compounds represented by the general formulae (I) and (II) have boiling points of 200° C. or higher (at one atmospheric pressure).

The high boiling point organic solvent constituted with the compounds of general formulae (I) and (II) is used in an amount corresponding to the ratio (by weight) of 0.05 to 15, preferably 0.1 to 6, to the amount of a color coupler used.

In the present invention, known phthalic or phosphoric acid ester series high boiling point organic solvents can be used in combination with the high boiling point organic solvents represented by the general formulae (I) and (II). In this case, the compounds represented by the general formulae (I) and (II), in all, should constitute 10 wt% or more, and particularly 50 wt% or more, of the total high boiling point organic solvent.

The present invention does not impose any particular restrictions on the process for dispersing a color coupler using the compounds represented by the general formulae (I) and (II). In case of the dispersion, low boiling point assistant solvents such as methyl acetate, butyl acetate, methyl isobutylene, methyl cellosolve, dimethylformamide and so on; dispersing aids such as sodium alkylbenzenesulfonate, sodium dodecylsulfate, N-tetradecyl-N,N-dipolyethylene-α-betaine, sorbitol monolaurate and the like; and so on can be used together with the high boiling point organic solvents.

In the general formula (III), benzyl and methyl groups are preferred as $R_6$, and methyl and ethyl groups are preferred as $R_7$. Preferred substituent groups with which the groups represented by $R_7$ may be substituted include methoxy, ethoxy, methylsulfonyl and methylsulfonamido groups. Preferred groups as $R_{10}$ are hydrogen and a methoxy group.

Specific examples of the compound represented by the general formula (III) are illustrated below.

Compound Examples:
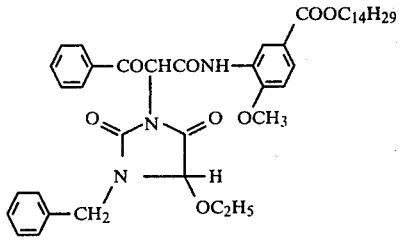
(III-1)
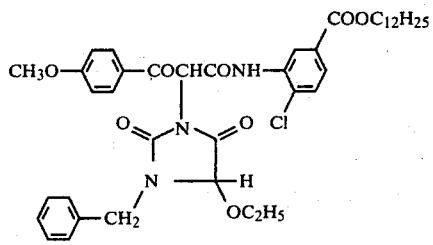
(III-2)
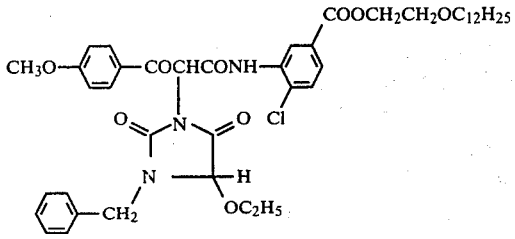
(III-3)
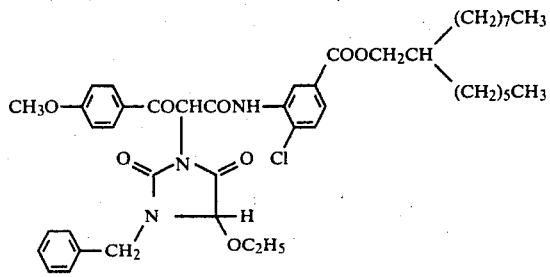
(III-4)
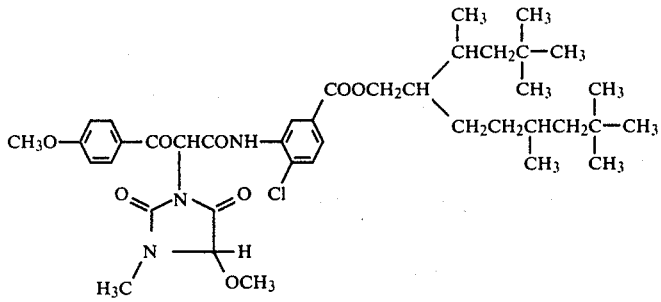
(III-5)
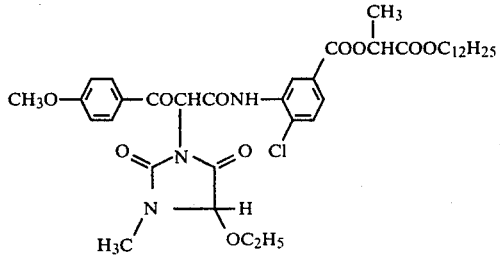
(III-6)
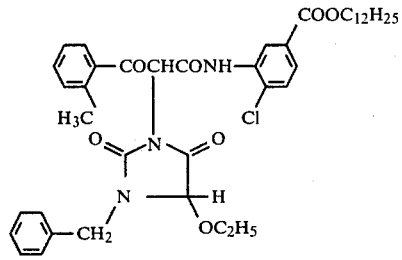
(III-7)
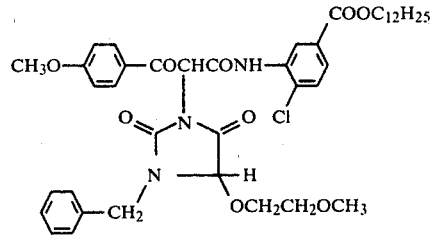
(III-8)

-continued

Compound Examples:

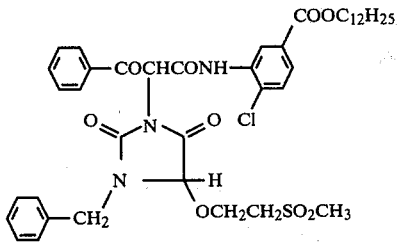

(III-9)

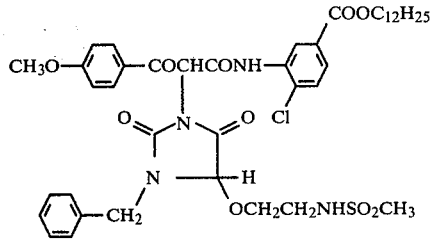

(III-10)

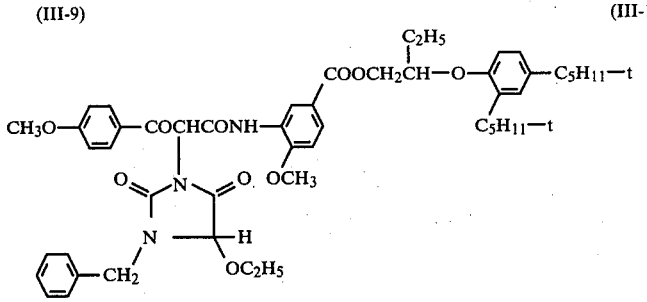

(III-11)

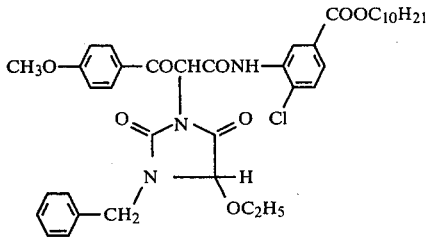

(III-12)

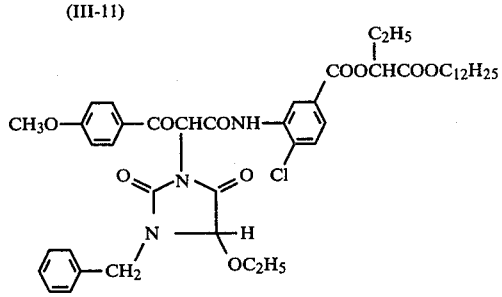

(III-13)

Specific examples of the compound represented by the general formula (IV) are illustrated below.

Compound Examples:

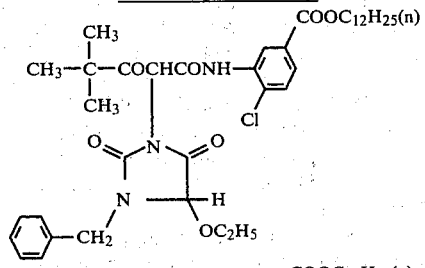

(IV-1)

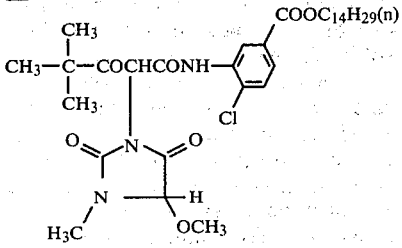

(IV-2)

-continued

Compound Examples:

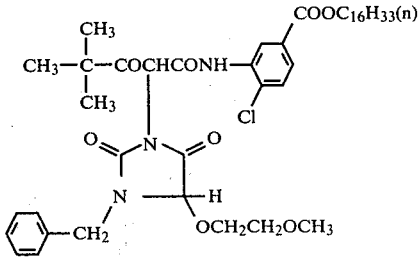

(IV-3)

A yellow coupler to be employed in the present invention is selected from those which are represented by the above-described general formula (III) or (IV), but the compounds represented by the general formula (III) are particularly preferred.

In the present invention, other known yellow couplers can be used in addition to the above-described yellow couplers.

In case of such combined use, 4-equivalent yellow couplers (e.g., benzoylacetanilides and pivaloylacetanilides) are particularly preferred.

Specific examples of preferred 4-equivalent yellow couplers are illustrated below.

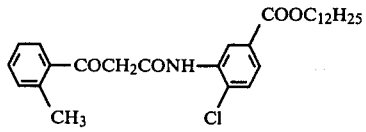

(V-1)

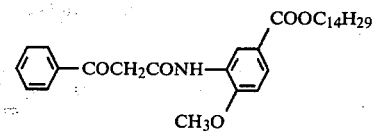

(V-2)

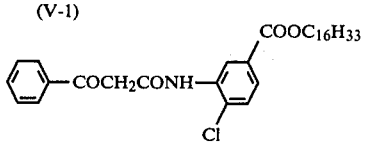

(V-3)

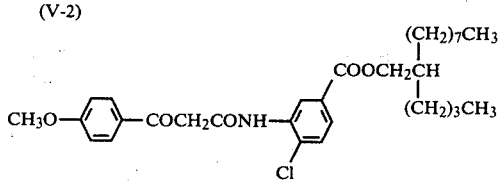

(V-4)

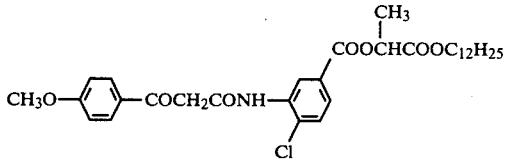

(V-5)

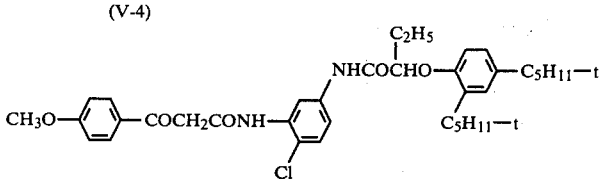

(V-6)

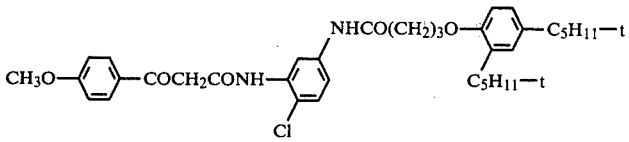

(V-7)

The amount of the color coupler added to a silver halide emulsion in accordance with an embodiment of the present invention ranges from $2\times10^{-3}$ to $5\times10^{-1}$ mol, and preferably from $1\times10^{-2}$ to $5\times10^{-1}$ mol, per mol of silver halide contained in the emulsion.

In the present invention, known magenta and cyan couplers can be used. Specific examples of magenta couplers are given in, e.g., U.S. Pat. No. 3,615,506 and German Patent Application (OLS) Nos. 2,418,959 and 2,424,467; and specific examples of cyan couplers are given in, e.g., U.S. Pat. Nos. 2,474,293, 3,034,892, 3,591,383, 3,311,476 and 3,476,563. A further description of these color couplers is given in *Research Disclosure*, Vol. 176, page 25 (December, 1978).

In the present invention, gelatin can be advantageously employed as a binder or protective colloid for silver halide emulsion layers and other hydrophilic colloidal layers. However, hydrophilic colloids other than gelatin may be used. Examples of usable hydrophilic colloids include proteins such as gelatin derivatives, graft polymers of gelatin and other macromolecules, albumin, casein, etc.; cellulose derivatives such as hydroxyethyl cellulose, carboxymethyl cellulose, cellulose sulfate, etc.; sugar derivatives such as sodium alginate, starch derivatives, etc.; and wide variety of synthetic hydrophilic macromolecular compounds with specific examples including such homo- and copolymers as polyvinyl alcohol, partially acetalated polyvinyl alcohol, poly-N-vinyl yrrolidone, polyacrylic acid, polymethacrylic acid, polyacrylamide, polyvinyl imidazole, polyvinyl pyrazole and the like.

Examples of useful gelatins include lime-processed gelatin and acid-processed gelatin. In addition, hydrolysis products and enzymatic degradation products of gelatin can be used. As gelatin derivatives, those obtained by reacting gelatin with acid halides, acid anhydrides, isocyanates, bromoacetic acid, alkane sultones, vinyl sulfonamides, maleinimido compounds, polyalkylene oxides, epoxy compounds or other various compounds are employed.

The color sensitive materials of the present invention may contain as color fog inhibitors hydroquinone derivatives, aminophenol derivatives, gallic acid derivatives, ascorbic acid derivatives. Specific examples thereof are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77 (the term "OPI" as used herein refers to a "published unexamined Japanese patent application"), Japanese Patent Publication No. 23813/75 and so on.

The color sensitive material of the present invention can further contain an ultraviolet absorbing agent such as a benzotriazole compound substituted with an aryl group, a 4-thiazolidone compound, a benzophenone compound, a cinnamic acid ester compound, a butadiene compound, a benzoxazole compound or the like.

In embodying the present invention, known discoloration inhibitors can be used jointly with the dye image stabilizer. Such image stabilizing can be used independently or in combination of two or more kinds. Specific examples of known discoloration inhibitors include hydroquinone derivatives as described in, e.g., U.S. Pat.

Nos. 2,360,290, 2,418,613, 2,675,314, 2,701,197, 2,704,713, 2,728,659, 2,732,300, 2,735,765, 2,710,801 and 2,816,028, British Pat. No. 1,363,921; and gallic acid derivatives as described in, e.g., U.S. Pat. Nos. 3,457,079 and 3,069,262; and p-alkoxyphenols as described in, e.g., U.S. Pat. Nos. 2,735,765 and 3,698,909, and Japanese Patent Publication Nos. 20977/74 and 6623/77; p-oxyphenol derivatives as described in, e.g., U.S. Pat. Nos. 3,432,300, 3,573,050, 3,574,627 and 3,764,337, and Japanese Patent Application (OPI) Nos. 35633/77, 147434/77 and 152225/77; and bisphenols as described in U.S. Pat. No. 3,700,455.

The present invention does not place any special restrictions on the process used for making the light-sensitive silver halide emulsions; the kinds and the contents of light-sensitive silver halides, chemical sensitizers, anti-foggants, gelatin hardeners, spectrally sensitizing dyes, surface active agents, polymer latex, slipping agents, matting agents, dyes and other additives, which are the constituents of the silver halide emulsion layers or other layers. Examples of these constituents are given in *Research Disclosure,* Vol. 176, pages 22–28 (December, 1978).

A color developing solution is, in general, an alkaline aqueous solution containing a color developing agent. Examples of useful color developing agents include known primary aromatic amine developers such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition, those described in L. F. A. Mason, *Photographic Processing Chemistry,* pages 226–229, Focal Press (1966), U.S. Pat. Nos. 2,193,015 and 2,592,364, Japanese Patent Application (OPI) No. 64933/73 and so on may be employed.

After color development, photographic emulsion layers are generally subjected to a bleaching process. The bleaching processing may be carried out simultaneously with a fixation processing (i.e., blix processing), or these two processings may be carried out separately. Examples of a bleaching agent which may be used in the bleaching processing include compounds of such polyvalent metals as Fe(III), Co(III), Cr(VI), Cu(II) and the like; peroxy acids; quinones; nitroso compounds and so on. More specifically, they are ferricyanides; bichromates; complex salts of Fe(III) or Co(III) and such organic acids as ethylenediaminetetraacetic acid, nitrilotriacetic acid, 1,3-diamino-2-propanoltetraacetic acid and other aminopolycarboxylic acids, citric acid, tartaric acid, malic acid, etc.; persulfates; permanganates; nitrosophenols; and so on. Of these bleaching agents, potassium ferricyanide, sodium ethylenediaminetetraacetonatoferrate (III) and ammonium ethylenediaminetetraacetonatoferrate (III) are particularly useful.

Among these bleaching agents, potassium ferricyanide is most liable to cause a processing stain in the color sensitive material. Therefore, when this bleaching agent is used the improved results of the present invention are fully shown.

To a bleaching bath or a bleach-fix bath, bleach accelerators as described in U.S. Pat. Nos. 3,042,520 and 3,241,966, Japanese Patent Publication Nos. 8506/70 and 8836/70; thiol compounds described in Japanese Patent Application (OPI) No. 65732/78, and other various additives can be added.

The following example is given to further illustrate this invention in greater detail.

EXAMPLE

The layers described below were coated on a cellulose triacetate film support. The first layer is the lowest layer and the sixth layer is the uppermost layer. The resulting multilayer color sensitive film is referred to as Sample 1.

(In the following table, the amount of each constituent coated is expressed in mg/m$^2$.)

| | | |
|---|---|---|
| Sixth Layer (protecting layer) | Gelatin | 750 mg/m$^2$ |
| Fifth Layer | Silver Chlorobromide Emulsion | |
| (green-sensitive layer) | Silver Bromide: 30 mol % | |
| | Silver: 500 mg/m$^2$ | |
| | Gelatin | 1,300 mg/m$^2$ |
| | Magenta Coupler *1 | 600 mg/m$^2$ |
| | Coupler Solvent *2 | 110 mg/m$^2$ |
| Fourth Layer | Gelatin | 500 mg/m$^2$ |
| Third Layer | Silver Chlorobromide Emulsion | |
| (red-sensitive layer) | Silver Bromide: 30 mol % | |
| | Silver: | 500 mg/m$^2$ |
| | Gelatin | 2,900 mg/m$^2$ |
| | Cyan Coupler *3 | 1,500 mg/m$^2$ |
| | Coupler Solvent *4 | 700 mg/m$^2$ |
| Second Layer | Gelatin | 500 mg/m$^2$ |
| First Layer | Silver Iodobromide Emulsion | |
| (blue-sensitive layer) | Silver Iodide: 0.2 mol % | |
| | Silver: | 100 mg/m$^2$ |
| | Gelatin | 2,200 mg/m$^2$ |
| | Yellow Coupler *5 | 1,200 mg/m$^2$ |
| | Coupler Solvent *6 | 600 mg/m$^2$ |
| Support | Cellulose Triacetate | |

*1 Magenta coupler: 3-{3-[2-(2,4-Di-t-amylphenoxy)-acetamido]benzamido}-1-(2,4,6-trichlorophenyl)-2-pyrazolin-5-one
*2 Coupler solvent: Phosphoric acid cresol ester
*3 Cyan coupler: 2-Benzamido-4-chloro-5-[α-(3'-methanesulfonylaminophenoxy)-tetradecanamido]phenol
*4 Coupler solvent: Phthalic acid butyl alcohol ester
*5 Yellow coupler: Compound Example (III-2) of this invention
*6 Coupler solvent: Tricresyl phosphate (TCP)

Sample 2 was prepared in the same manner as in the preparation of Sample 1 except that dibutyl phthalate (DBP) was employed as the solvent for the yellow coupler instead of TCP.

Sample 3 was prepared in the same manner as in the preparation of Sample 1 except that the Compound Example (I-3) of this invention was employed as the solvent for the yellow coupler.

Sample 4 was prepared in the same manner as in the preparation of Sample 1 except that the Compound Example (II-2) of this invention was employed as the solvent for the yellow coupler.

Sample 5 was prepared in the same manner as in the preparation of Sample 3 except that a 50 mol% portion of the Compound Example (I-3) was replaced by the Compound Example (II-2).

Sample 6 was prepared in the same manner as in the preparation of Sample 5 except that a 20 mol% portion of the yellow coupler (Compound Example (III-2)) was replaced by the yellow coupler of the Compound Example (V-1).

Each of these samples was exposed to blue light, green light and red light through continuous wedge, and subjected to the following processings.

| Processing | Temperature (°C.) | Time |
|---|---|---|
| 1. Color Development | 36 | 3 minutes |
| 2. Stop | 25–30 | 40 seconds |
| 3. First Fixation | 25–30 | 40 seconds |
| 4. Bleach | 25–30 | 1 minute |
| 5. Second Fixation | 25–30 | 40 seconds |
| 6. Washing | 25–30 | 30 seconds |

Processing solutions employed in these processing steps, respectively, had the following compositions.

| | |
|---|---|
| Color Developing Solution | |
| Sodium Sulfite | 5.0 g |
| 4-Amino-3-methyl-N,N-diethylaniline | 3.0 g |
| Sodium Carbonate | 20.0 g |
| Potassium Bromide | 2.0 g |
| Water to make | 1 l |
| | adjusted to pH = 10.5 |
| Stop Solution | |
| Sulfuric Acid (6N) | 50.0 ml |
| Water to make | 1 l |
| | adjusted to pH = 1.0 |
| Fixing Solution | |
| Ammonium Thiosulfate | 60.0 g |
| Sodium Sulfite | 2.0 g |
| Sodium Hydrogensulfite | 10.0 g |
| Water to make | 1 l |
| | adjusted to pH = 5.8 |
| Bleaching Solution | |
| Potassium Ferricyanide | 30.0 g |
| Potassium Bromide | 15.0 g |
| Water to make | 1 l |
| | adjusted to pH = 6.5 |

The degree of stain produced in the colorless (non-image) area of each sample after development process was examined. Furthermore, the stain densities of these samples were measured through a blue filter Status A-(TD-504A) using a Macbeth densitometer and the results of these measurements were compared with one another.

The results obtained are shown in Table 1.

TABLE 1

| Sample No. | Solvent for Coupler | Yellow Coupler | Processing Stain |
|---|---|---|---|
| 1 (Comparison) | TCP | Compound Example (III-2) | 0.15 |
| 2 (Comparison) | DBP | Compound Example (III-2) | 0.15 |
| 3 (This Invention) | Compound Example (I-3) | Compound Example (III-2) | 0.10 |
| 4 (This Invention) | Compound Example (II-2) | Compound Example (III-2) | 0.12 |
| 5 (This Invention | (I-3)/(II-2)= 1/1 | Compound Example (III-2) | 0.10 |
| 6 (This Invention) | (1-3)/(II-2)= 1/1 | (III-2)/(V-1)= 8/2 | 0.10 |

As can be seen from Table 1, the Samples (3) to (6), which were prepared in accordance with embodiments of the present invention, show marked reduction of processing stain formation.

Further, after storage at 40° C. for 10 days, each of the samples was subjected to the above-described processings in the similar manner. Densities of the yellow images produced in Samples (1) and (2), respectively, increased remarkably, compared with those observed in their respective samples by the development processing immediately after coating of the constituent layers. However, the Samples (3) to (6) did not show such increase in the yellow image densities as described above.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a layer comprising a color coupler dispersed within a high boiling point organic solvent, said high boiling point organic solvent being selected from compounds of general formulae (I) and (II), and said color coupler being selected from compounds of general formulae (III) and (IV):

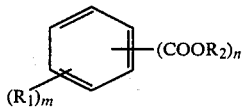

(I)

wherein $R_1$ is an alkyl group, an alkoxy group, an acyloxy group, an aryloxy group or a halogen atom; $R_2$ is a cyclic saturated hydrocarbon residue; m is 0 or an integer of 1 to 5; and n is an integer of 1 to 6; and wherein when m or n is an integer of 2 or more, each $R_1$ and $R_2$ may be the same or different;

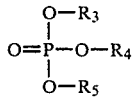

(II)

wherein $R_3$ is a cyclic saturated hydrocarbon residue; and $R_4$ and $R_5$, which may be the same or different, each represents a cyclic saturated hydrocarbon residue, an alkyl group or an aryl group;

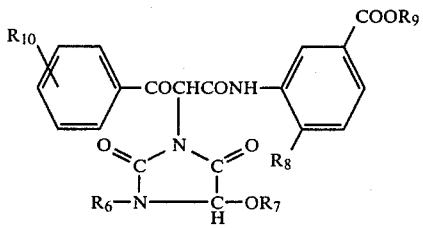

(III)

wherein $R_6$ is an alkyl group containing 1 to 10 carbon atoms, which may be substituted with a phenyl group; $R_7$ is an alkyl group containing 1 to 12 carbon atoms, which may be substituted with an alkoxy group, an alkylsulfonamido group or an alkylsulfonyl group; $R_8$ is a chlorine atom or a methoxy group; $R_9$ is an alkyl group containing 10 to 20 total carbon atoms, which may be substituted with an alkoxy group, a phenoxy group, an alkoxycarbonyl group or an alkylsulfonamido group; and $R_{10}$ is hydrogen, a methyl group or a methoxy group;

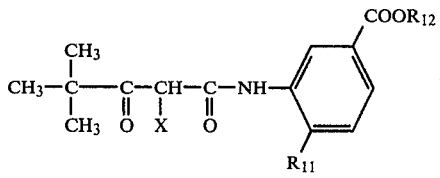

(IV)

wherein $R_{11}$ is a chlorine atom or a methoxy group; $R_{12}$ is an alkyl group containing 10 to 20 total carbon atoms, which may be substituted with an alkoxy group, a phenoxy group, an alkylcarbonyl group or an alkylsulfonamido group; and X is a 2,4-dioxo-5,5-dimethyl-3-oxazolydinyl group or a group having the formula:

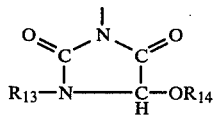

(wherein $R_{13}$ is an alkyl group containing 1 to 10 carbon atoms, which may be substituted with a phenyl group; and $R_{14}$ is an alkyl group containing 1 to 10 carbon atoms, which may be substituted with an alkoxy group, an alkylsulfonamido group or an alkylsulfonyl group).

2. The silver halide color photographic light-sensitive material as claimed in claim 1, wherein said $R_1$ is an alkyl group containing 1 to 12 carbon atoms, an alkoxy group containing 1 to 10 carbon atoms, an acyloxy group containing 1 to 20 carbon atoms, an aryloxy group containing 6 to 18 carbon atoms, or a halogen atom.

3. The silver halide color photographic light-sensitive material as claimed in claim 1, wherein said $R_1$ is an alkoxy group containing 1 to 9 carbon atoms or a chlorine atom.

4. The silver halide color photographic light-sensitive material as claimed in claim 1, wherein said $R_2$ is a cyclic saturated hydrocarbon residue containing 3 to 24 carbon atoms.

5. The silver halide color photographic light-sensitive material as claimed in claim 1, wherein said $R_2$ is a cyclohexyl group.

6. The silver halide color photographic light-sensitive material as claimed in claim 1, wherein said $R_3$ is a substituted or unsubstituted cyclic saturated hydrocarbon residue containing 5 or more carbon atoms.

7. The silver halide color photographic light-sensitive material as claimed in claim 1, wherein said $R_3$ is a substituted or unsubstituted cyclohexyl group.

8. The silver halide color photographic light-sensitive material as claimed in claim 1, wherein said $R_4$ and $R_5$ each is a substituted or unsubstituted cyclic saturated hydrocarbon residue containing 5 or more carbon atoms, a substituted or unsubstituted alkyl group containing 1 to 30 carbon atoms or a substituted or unsubstituted aryl group containing 6 to 24 carbon atoms.

9. The silver halide color photographic light-sensitive material as claimed in claim 1, wherein said $R_4$ and $R_5$ each is a substituted or unsubstituted cyclohexyl group.

10. The silver halide color photographic light-sensitive material as claimed in claim 1, wherein said $R_6$ is a methyl group or a benzyl group.

11. The silver halide color photographic light-sensitive material as claimed in claim 1, wherein said $R_7$ is a methyl group or an ethyl group.

12. The silver halide color photographic light-sensitive material as claimed in claim 11, wherein said methyl and ethyl groups for $R_7$ each is further substituted with a methoxy group, an ethoxy group, a methylsulfonyl group or a methylsulfonamido group.

13. The silver halide color photographic light-sensitive material as claimed in claim 1, wherein said $R_{10}$ is hydrogen or a methoxy group.

14. The silver halide color photographic light-sensitive material as claimed in claim 1, wherein said color coupler is the compound of the general formula (III).

15. The silver halide color photographic light-sensitive material as claimed in claim 1, wherein said color coupler is used in an amount of $2\times10^{-3}$ to $5\times10^{-1}$ mol per mol of silver halide.

16. The silver halide color photographic light-sensitive material as claimed in claim 1, wherein weight ratio of said high boiling point organic solvent of general formulae (I) and (II) to the color coupler is 0.05 to 15.

* * * * *